United States Patent [19]

Stepanenko et al.

[11] Patent Number: 4,982,780

[45] Date of Patent: Jan. 8, 1991

[54] METHOD OF PRODUCING METAL FILAMENT AND APPARATUS MATERIALIZING SAME

[76] Inventors: Alexandr V. Stepanenko, ulitsa Surganova, 10, Kv. 25, Minsk; Mikhail N. Vereschagin, ulitsa Ogorenko, 17, kv. 149; Oleg I. Paly, ulitsa Staro-Chernigovskaya, 15, kv. 76, both of Gomel; Valery K. Sheleg, prospekt Masherova, 3, kv. 38; Vyacheslav M. Kaptsevich, ulitsa Surganova, 60/1, kv. 55, both of Minsk; Valery E. Gorunov, ulitsa Pesina, 78, kv. 54; Evgeny A. Lapitsky, ulitsa Bogdanova, 1, kv. 22, both of Gomel; Anatoly G. Kostornov, ulitsa Juliusa Fuchika, 13, kv. 26, Kiev; Alexandr V. Kholomeev, Roschinsky pereulok, 1, kv. 1, Gomel, all of U.S.S.R.

[21] Appl. No.: 336,670

[22] PCT Filed: Jul. 18, 1988

[86] PCT No.: PCT/SU88/00138

§ 371 Date: Mar. 21, 1989

§ 102(e) Date: Mar. 21, 1989

[87] PCT Pub. No.: WO89/00468

PCT Pub. Date: Jan. 26, 1989

[30] Foreign Application Priority Data

| | | | |
|---|---|---|---|
| Jul. 21, 1987 | [SU] | U.S.S.R. | 4272733 |
| Jul. 21, 1987 | [SU] | U.S.S.R. | 4272731 |
| Jul. 21, 1987 | [SU] | U.S.S.R. | 4272728 |
| Jul. 21, 1987 | [SU] | U.S.S.R. | 4272730 |

[51] Int. Cl.[5] ..... B22D 11/06

[52] U.S. Cl. ..... 164/463; 164/479; 164/428

[58] Field of Search ..... 164/463, 423, 429, 479, 164/480, 428, 481, 432

[56] References Cited

U.S. PATENT DOCUMENTS

| | | | |
|---|---|---|---|
| 2,886,866 | 5/1959 | Wade . | |
| 3,881,540 | 5/1975 | Kavesh . | |
| 4,154,233 | 5/1979 | Ray et al. . | |

FOREIGN PATENT DOCUMENTS

| | | | |
|---|---|---|---|
| 2368324 | 5/1978 | France . | |
| 55-73449 | 6/1980 | Japan | 164/423 |
| 60-196251 | 10/1985 | Japan | 164/463 |
| 61-43147 | 9/1986 | Japan . | |
| 61-206549 | 9/1986 | Japan | 164/428 |

*Primary Examiner*—Kuang Y. Lin

*Attorney, Agent, or Firm*—Fleit, Jacobson, Cohn, Price, Holman & Stern

[57] ABSTRACT

The invention relates to the continuous casting of metals into moulds with movable walls. According to the method of producing metal filament, a fraction of molten metal is continuously fed onto an additional chill surface which is contiguous to a main chill surface and displaces relative thereto so that an additional metal filament is formed on the additional chill surface before being separated from this surface and coiled. The apparatus materializing the method incorporates a means (1) of forming metal filament an additional closed chill surface (4) whereof is coupled to an individual drive (9) and to a means (31) of coiling the additional metal filament (32) and is located next to and in contact with the main closed chill surface (2). A feeder (15) is disposed above a zone of contact between the main and additional chill surfaces.

5 Claims, 5 Drawing Sheets

METHOD OF PRODUCING METAL FILAMENT AND APPARATUS MATERIALIZING SAME

TECHNICAL FIELD

The present invention relates to the continuous casting of metals into moulds with movable walls which can be of any form such as, e.g., plates, barrels, discs and strip suitable for the production of products with an unlimited length and has specific reference to methods of making metal filaments and apparatus materializing such method.

Within the scope of the present invention, the term metal filament refers to a slender body whose transverse dimensions are substantially less than its length.

Accordingly, filaments can be such bodies as ribbon, strip, sheet and wire of constant or variable cross section.

PRIOR ART

Known in the art is a method of producing metal filaments (U.S. Pat. No. 4,154,283) according whereto a metal from a molten source is continuously cast on an unceasingly moving quench surface, a metal filament is formed thereupon which is then separated from the quench surface and coiled.

The prior art method provides for producing metal filament with even edges and a specified structure, e.g. an amorphous one. In the prior art method, the metal is fed from the molten source to the movable quench surface in a continuous stream of circular or rectangular cross-sectional area at a given rate. An impact of the melt with the quench surface causes the melt to spread into a pool of a width which is greater than the diameter of the cross-sectional area of the stream, or the width thereof if the melt has a rectangular cross-sectional area.

It is known that the pool of melt retains its stability as long as the quench surface cools down and withdraws the lower layer thereof at the place of contact in the form of a formed continuous filament. Retaining its shape due to a high surface tension of the molten metal, the pool in fact rises upstream of the melt until the stable state is attained.

It is also known that the thickness of the filament so formed various directly with the length of the pool melt at the quench surface and inversely with the rate of displacement of this surface. Since the width of the metal filament so formed equals that of the pool of melt, the prior art method is suitable for forming filaments of rectangular cross-sectional area only. Filament with square cross-sectional area cannot be formed in the known way.

The casting of the filament takes place in a vacuum.

It is known that in the absence of vacuum a thin gas layer, referred to as boundary gas layer, is formed between the quench surface and the surrounding molecules of gas which are moving in this layer at a speed equalling that of the quench surface. The inherent properties of the gas layer and the way in which the layer interacts with the pool of metal, continuously extracted wherefrom and formed is the metal filament, give rise to surface irregularities at the edges of the metal filament. Only the thin gas layer which is in direct contact with the quench surface has effect on the width of the pool. A metal filament in the form of e.g. a ribbon with even edges can form only when the Reynolds number of the boundary gas layer is less than a certain critical value. Should the Reynolds number exceed the critical value, a turbulence of the gas near the pool of metal gives origin to irregular edges of the ribbon. In a vacuum, no boundary gas layer is formed and irregularities of the edges are prevented.

When a metal filament is cast in vacuum, the period of its contact with the quench surface cannot be extended by resorting to the pressure of a cooling gas flow. Sophisticated equipment is required, compared with the extracting of filament under the atmospheric pressure.

The prior art method is of no avail in producing metal filament of a constant thickness but with a width progressively decreasing with the length. As pointed out hereinabove, the width of filament is decided by the width of pool of melt and this, in its turn, is controlled by the size of the cross-section of the flow of melt, e.g. by its diameter, and the velocity of the flow. The prior art method does not permit any alteration of the cross-section of the melt flow in the course of extracting filament, for no features of the design of the apparatus materializing this method—which are appropriate for the case—exist there. No filament with a width which is less than the diameter of the cross-sectional area of the melt flow can be produced by the prior art method.

The prior art method is materialized with the aid of an apparatus (U.S. Pat. No. 4,154,283) incorporating a means of forming metal filament from a molten metal having a closed chill surface, a means of imparting motion to the closed chill surface, a feeder ejecting molten metal onto the closed chill surface and a means of coiling the filament formed on the chill surface. The apparatus operates in a vacuum chamber.

The means of forming metal filament consists of a hollow water-cooled cylinder fitted with provision for revolving on a shaft coupled to a rotary drive of any known type. The side surface of the cylinder is the chill surface.

The feeder ejecting molten metal onto the side surface of the cylinder consists of a crucible which is contained in a heated housing and has a nozzle with an orific of e.g., circular cross section in its bottom.

However, the prior art apparatus is capable of producing a filament with a width which is less than the diameter of the nozzle orifice, for the melt ejected from the feeder nozzle in the form of a stream with a cross-sectional area the diameter whereof equals that of the nozzle orifice impinges upon the moving chill surface of the cylinder so as to form a pool the width whereof exceeds the orifice diameter. The width of the filament is decided by the width of the melt pool on the surface of the cylinder.

Therefore, the prior art apparatus is suitable for producing a filament only of a rectangular cross sectional area the width whereof is decided by the width of the melt pool and the thickness whereof varies with the velocity of the side surface of the cylinder.

The filament width can be reduced by reducing the diameter of the feeder nozzle orifice. The diameter of the cross-sectional area of the stream of melt emerging from the feeder will then definitely decrease and so will the width of the pool and that of the filament formed therefrom.

However, feeder nozzle with small orifices, e.g. those of the capillary type, offer a high resistance to the melt flow, particularly when the melt viscosity is high. To overcome the resistance to the flow of the melt through the capillary-type orifices, a significant overpressure of a gas must be set up in the crucible and the melt must be heated up well above its melting point so as to minimize the viscosity thereof. Yet, melt viscosity is recultant to lower rapidly with a temperature rise, and the gas overpressure is limited by the strength of the crucible material, especially when the melting point of the metal is as high as 1800° K. Therefore, the casting of an iron-base metal filament with a width less than 100 μm is in fact a problem for the prior art apparatus. Not excluded is the possibility of plugging capillary-type feeder orifices with solid inclusions—products of oxidation of the melt in the crucible, and foreign articles.

Since the melt impinging upon the chill surface of the prior art apparatus spreads into a pool, filaments with a rectangular cross-sectional area are the only product produced. Filaments with a square cross-sectional area, i.e. those with a width equalling their thickness, cannot be formed on the prior art apparatus. A lack thereon of a means of changing the nozzle orifice diameter controlling the filament width in the course of casting, does not permit the production of metal filaments of a constant thickness and a continuously decreasing width (the so called tapering-off filaments).

The same reason prevents the casting of filaments of a variable width which is less than the width of the nozzle outlet. This prevents the use of unified feeders and necessitates a switch over to a feeder of another size each time the filament width must be reduced.

Also known in the art is a method of producing metal filament (U.S. Pat. No. 3,881,540) according where to a molten metal is continuously cast on an unceasingly moving chill surface, a metal filament is formed from the melt which is separated then from the chill surface and cooled.

Centrifugal forces coming into play in this case press the melt against the moving chill surface in the course of forming the filament. The heat transfer from the melt to the chill surface improves and the rate of melt cooling increases so that amorphous filament is obtained.

The product is metal filament of constant width with rectangular cross-sectional area, provided an effective control of the process variable is executed. This applies to the velocity of the chill surface which must be constant, the temperature of the chill surface and that of the melt, the rate of melt feed and other parameters known to those versed in the art. A deviation of any of the parameters from the set value, e.g. this may be the rate of feeding the melt to the chill surface, has effect on the shape of the pool, which may change its width, so that the width of the filament formed will change as well.

The method relies on a melt flow with a constant cross-sectional area and is therefore inapplicable for the production of square-section filaments, those of a width continuously reducing with the length and filaments of variable width with even edges. The reasons are the same as those considered hereinabove.

The method is materialized in an apparatus (U.S. Pat. No. 3,881,540) incorporating a means of forming metal filament from molten metal which features a closed chill surface and is coupled to a means of imparting motion to this surface, a means of feeding the molten metal onto the closed chill surface and a means of coiling the filament formed on the chill surface.

The means of forming metal filament consists of a water-cooled wheel in a material with a high thermal conductivity which is installed with provision for revolving and is coupled to a rotary drive. The wheel can be made open on both sides or on one only, depending on the rotary drive employed. An internal side surface of the wheel is inclined towards the axis of rotation and serves as the chill surface.

The means of feeding the molten metal onto the internal side surface of the wheel consists of a crucible heated by induction or resistance to keep the melt at a specified temperature. Nozzles with orifices, of, e.g., circular cross section are provided in the bottom of the crucible.

A good heat transfer from the melt to the internal side surface of the wheel achieved on the prior art apparatus due to a compressive effect of the centrifugal forces is conductive to producing quality filament of a given, e.g., amorphous structure. The apparatus yields filament of constant width over the entire length.

But no filament of a constant width can be produced unless the main process variables such as the rate of feeding the melt onto the chill surface, melt temperature, the velocity of the chill surface, etc. remain unchanged.

The disadvantages of this prior art apparatus are identical with those of other known outfits. It cannot produce metal filament of square cross section, i.e. one of a width equalling its thickness. Lack of a means of reducing the size of the feeder nozzle orifice renders impossible a controlled reduction of the filament width.

The inability to produce square section filament appears to be even more pronounced due to the compressive effect of centrifugal forces which brings about a more rapid spreading of the ejected melt over the chill surface than this is the case when the melt impinges upon the outward side surface of the cylinder and the centrifugal forces tend to throw the melt off the chill surface of the apparatus described hereinabove.

Further known in the art is a method of producing metal filament (FR; A; No. 2,368,324) according whereto molten metal is continuously fed onto an unceasingly displacing chill surface and a metal filament is formed from the melt which is then separated from the chill surface and coiled.

This method is suitable for producing metal filament in the form of a ribbon of given structure with even edges. However, the forming of constant-width filament is possible only if the main process variables remain constant. This refers to the width of the melt flow, the rate of feeding the melt onto the chill surface, melt temperature, the velocity of the chill surface, its temperature and other parameters known to those versed in the art which are controllable with difficulty.

Other disadvantages of the prior art method described hereinabove are also inherent in the method under consideration. No filaments with a square cross-sectional area, i.e. those with a width equalling their thickness, can be produced due to lack of a means of controlling the dimensions of the cross section of the melt flow which is being fed. Filaments of a width constantly decreasing with their length and filaments of different standard widths with even edges fall outside the possible product range.

This prior art method is materialized in an apparatus (FR; A; No. 2,368,324) incorporating a means of forming metal filament from molten metal which has a closed chill surface coupled to a means of displacing it, a feeder for feeding molten metal onto the closed chill surface and a means of cooling the metal filament formed on the chill surface.

The means of forming metal filament may be provided in the form of a water-cooled cylinder which is installed with provision for revolving and is coupled to a rotary drive. An outward side surface of the cylinder serves as the closed chill surface.

The apparatus may also be provided with the means of forming metal filament in the form of an endless metal belt which is supported with provision for displacement by at least two pulleys and whose outward side surface serves as the chill surface. The endless belt is cooled by a stream of cooling gas.

The feeder surmounts the chill surface and consists of an induction- or resistance-heated crucible to keep the melt at a specified temperature. A nozzle with a precision outlet slot is fitted to the crucible bottom. The width of the slot corresponds to that of the filament. The means of coiling the filament consists of a rotatable reel with a clamp.

The apparatus yields metal filament in the form of a constant-width ribbon with even edges which may be amorphous or fine-grain crystalline. The ribbon must be not only of a constant width but also of a specified one or otherwise slitting will be indispensable.

Ribbon of specified width is obtained by employing a feeder nozzle with a precisely-dimensioned outlet slot which is a rectangle in cross section the larger side whereof is regarded as the slot width deciding the width of the ribbon formed.

In setting the width of the nozzle outlet slot, many factors must be taken into account in order to obtain ribbon of specified width. For example, the thermal coefficient of expansion of the nozzle material, the rate of feed of the melt through the slot, the distance between the nozzle and the chill surface, the velocity of the chill surface and other parameters which influence the ribbon width and are known to those versed in the art must be taken into consideration. It is known that the rate of feed of the melt onto the chill surface and the distance of the feeder nozzle from the chill surface greatly influence the shape—i.e. the length and width—of the pool which is formed when the melt impinges upon the chill surface. Therefore, it is the width of the melt pool which decides in the end the width of the filament formed therefrom.

Thus, in setting the right width of the nozzle outlet, which will provide for forming filament of specified width, many difficulties are encountered. Not to be overlocked is the fact that the melt erodes the nozzle outlet in passing therethrough so that the feeder nozzle is not suitable for service after a short period in operation. A change over to a new nozzle or even feeder involves wastage of time and adds to the costs.

Lack of dimensional control of the nozzle outlet, e.g. of the width thereof, is another disadvantage of the apparatus which renders it unsuitable for the production of filaments with different standard width or with a width which gradually decreases with the length until its is equal or less than, the thickness thereof.

Since a switch over to another feeder nozzles is required each time the width of the filament is being changed, no unified nozzles can be used in order to produce filaments with different widths. Extra costs are required to meet the needs in additional standard nozzles, and time is wasted in changing nozzles.

When the apparatus is operated in an inert gas or in air under normal atmospheric pressure, a boundary gas layer may form at the chill surface which gives rise to pronounced irregularities of filament edges under certain conditions. Stringent product specifications call for slitting the filament in this case so as to remove the defective edges, provided the filament is of a width which permits slitting. Narrow filaments must be remelted.

To produce narrow filaments nozzle orifices of the capillary type must be used. Offering high resistance to the flow of the melt, such nozzles may cause an interruption of the flow. To prevent this, an inert gas overpressure is set up inside the feeder and the melt temperature is increased to a point increasing the melt fluidity. However, high temperature impairs the strength of the crucible made of a known material so that high overpressure and temperature must be avoided. Not excluded is the possibility that capillary-tape feeder nozzles may be stopped by solid oxide particles of a size commensurable with the cross-sectional area of the feeder nozzle orifices.

DISCLOSURE OF THE INVENTION

The principal object of the invention is to provide a method of producing metal filament and an apparatus materializing the method wherein a dynamic effect the molten metal is exposed to in the course of forming a metal filament and the features of the design of a means of forming the metal filament would care for reducing the width of the metal filament, stabilize and control the width of the metal filament along the length thereof in the course of producing the filament, retain the metal filament either amorphous or fine-grain crystalline and maintain unaltered the process variables during the feeding of the molten metal onto the chill surface.

This object is materialized by disclosing a method of producing metal filament consisting in continuously feeding a molten metal onto an unseasingly displacing main chill source, forming a metal filament from the melt, separating the metal filament from the main chill surface and cooling it wherein according to the invention a fraction of the molten metal is fed onto at least one additional chill surface which is located contiguously to the main chill surface and displaces relative thereto so that an additional metal filament is formed on the additional chill surface, separated therefrom and coiled.

It is expedient to displace the main and additional chill surfaces in the same direction at different velocities.

It is also expedient to displace the main and additional chill surface in opposite directions.

The feeding the molten metal onto the unceasingly displacing chill surface a layer of melt, referred to as pool, is formed on this surface. The pool originates due to an impact of the molten metal with the chill surface, and the width, length and height of the pool are influenced by many process variables. They are the flow rate of the melt fed onto the chill surface, melt temperature, the way of feeding the melt (e.g., if the melt is fed in a continuous stream the dimensions of the pool depend on the shape and size of the cross-sectional area of this stream), the velocity and temperature of the chill surface and other factors known to those versed in the art. A lower layer of the melt pool, i.e. one in direct contact with the chill surface, rapidly cools down and is withdrawn from the melt pool by the displacing chill surface as the continuous main metal filament. As the lower layer of the melt is being displaced lengthwise through the pool, cooling down at the same time, its thickness builds up until reaching the thickness of the metal filament formed at the end of the pool.

The dimensions of the metal filament so formed, i.e. the width and thickness thereof, are determined by the corresponding dimensions of the pool. Accordingly, the width of the formed metal filament corresponds to the width of the melt pool, and the thickness of the filament depends on the velocity of the chill surface and the width of the melt pool. The longer the pool and the lower the velocity of the chill surface, the thicker the filament and, conversely, the shorter the pool and the higher the velocity of the chill surface, the thinner the filament. The film thickness can also be reduced by increasing the chill surface velocity without a reduction of the pool length, for this will shorten the period during which the lower melt layer which is being cooled stays below the upper unsolidified layer of the pool.

Therefore, it stands to reason that the stability of the shape and size of the pool of melt during the period of withdrawing therefrom the lower part of the filament, which is maintained owing to the feeding of the melt under the conditions referred hereinabove, is a prerequisite for forming a continuous metal filament of, e.g., constant width.

The feeding of a fraction of the molten metal onto at least one additional chill surface contiguous to the main one provides for forming pools of melt on both the main and additional chill surfaces. The continuous flow of melt fed onto the main and additional chill surface gives rise to a single pool of melt comprising a main pool and an additional one joining each other between the main and additional chill surfaces. The aggregate width of the pools formed on the main and additional chill surface is assumed to be equal to the width of the pool formed only on the main chill surface due to feeding the melt only thereonto at the same rate.

The displacement of the additional chill surface relative to the main chill surface which is being displaced as well enables the lower solidifying layer of the melt in the additional pool which is in contact with the additional chill surface to displace relative to the lower solidifying layer of the melt in the main pool which is in contact with the main chill surface. Owing to the relative displacement of the main and additional chill surfaces, main and additional filaments are formed in, and withdrawn from, the respective pools of melt formed on the corresponding chill surfaces, whereby the direction and rate of withdrawal of the main and additional metal filaments correspond to the direction of displacement and the velocity of the main and additional chill surfaces.

The additional metal filament formed on the additional chill surface displaces with respect to the main metal filament formed on the main chill surface owing to appropriate cohesive forces set up between the lower layer of the melt in the additional and main pools, withdrawn wherefrom are the additional and main metal filaments, and the additional and main chill surfaces, respectively. The cohesive forces existing between the lower main and additional layers of melt and the corresponding chill surfaces must exceed the molecular forces in the unsolidified layers in the zone where the main and additional poles of melt join each other so as to provide for separating the additional metal filament from the main one and ensure an independent forming of the filaments on the corresponding chill surfaces.

If no displacement takes place between the additional and main chill surfaces, a single metal filament is formed with a width equalling the aggregate width of the main and additional pools of melt.

The main and additional metal filaments which have been formed in, and withdrawn from, the corresponding pools of melt and cooled to a specified temperature through the agency of the chill surfaces are separated therefrom and separately coiled in any known way.

Thus, the feeding of a fraction of melt onto the additional chill surface is conductive to forming two, not one, filaments referred to as the main and additional ones the aggregate width whereof is assumed to be equal to the width of the melt pool formed from the main and additional pools of melt.

By feeding a fraction of melt onto two additional chill surfaces located on either side of the main chill surface, it is possible to produce one main metal filament and two additional ones. The process of forming two additional metal filaments does not differ from that of casting one additional filament which is described hereinabove. The width of the main metal filament is then determined only by the width of the main chill surface and is not influenced by the factors relating to the feeding of melt. So, an increase in the rate of feeding the melt onto the three chill surfaces will make wider and longer the aggregate melt pool consisting of a main centrally located pool and two outermost additional pools which merge the main pool or, in other words, join it. However, the aggregate pool can widen only if the outermost additional pools are widened. The width of the main central pool remains constant, being always equal to the width of the main chill surface. A widening and elongation of the aggregate pool of melt results in forming thicker metal filaments, whereby the width of the main central filament remains constant and that of the additional outermost filaments increases by an amount corresponding to the increase in width of the aggregate pool of melt.

This creates the prospect of controlling the thickness of the main central filament without changing the width thereof by controlling such process variables as the rate of feed of the melt onto the chill surfaces, melt temperature, the velocity and temperature of the chill surface, etc.

In an absence of requirements specifying a difference between the thicknesses of the main and additional metal filaments when no sorting out of the main filament from the additional one is needed, as this is the case in manufacturing rope yarn, it is practical to displace the main and additional chill surfaces in the same direction at different velocities. No coiling of the main and additional filaments is then required and happers are used to collect the filaments which are set into motion in the same direction by the chill surfaces. The unidirectional displacement of the chill surfaces provides for a definite control of the thickness of the main and additional metal filaments. So, for example, the thickness of the main and additional filaments can be increased by elongating the aggregate pool of melt, and the difference between the thicknesses of the main and additional filaments can be maintained comparatively unchanged while definitely changing their thickness.

The fact that the chill surfaces displace with different velocities provides for separating the main and additional filaments formed from the aggregate pool of melt. A single metal filament with a width equalling that of the aggregate pool of melt is formed when the chill surface displace at the same velocity.

The need to produce the main and additional metal filaments with, e.g., the same thickness and width and coil both filaments separately is the reason why the main and additional chill surfaces are arranged to displace in opposite directions. To form the main and additional filaments with the same width and thickness, the melt is fed onto the corresponding chill surfaces so as to form thereon the main and additional pools of the same length, width and height. Since the chill surfaces displace at the same velocity, the main and additional filaments formed from these pools will be of the same dimensions.

The chill surfaces displacing in opposite directions provide for withdrawing the formed filaments also in opposite directions. This eases the problem of coiling the main and additional metal filaments separately by any known means. When two additional chill surfaces displacing in opposite direction compared with the main surface are used, there is no need to sort out the main filament from the additional ones. This is of practical value in producing main filament of a given constant width and remelting the additional filaments which can be easily collected in hoppers.

The need to produce, e.g., constant-thickness metal filament of a width continuously decreasing with the length and metal filament of variable standard width which may be in the end one equalling the filament thickness is the reason why a fraction of molten metal is fed onto an additional chill surface and this fraction is controlled by changing the fraction of molten metal fed onto the main chill surface.

As stated hereinabove, an aggregate pool of melt consisting of a main pool and an additional one is formed when the melt is fed onto the main and additional surfaces, and the widths of the main and additional metal filaments which are being formed are determined by the width of the main pool of melt and that of the additional pool, respectively. The ratio between the fractions of melt fed onto the main and additional chill surfaces can be changed so as to change the ratio between the dimensions of the main and additional pools of melt and, consequently, that between the dimensions of the main and additional filaments without changing the conditions of feeding the melt. This applies to the volumetric rate of melt feed, the rate of melt feed per unit time and the shape and dimensions of melt feed in cross section. The width of the aggregate pool of melt will then remain constant whatever the ratio between the widths of the main and additional pools of melt.

The ratio between the widths of the main and additional pools of melt and that between the fractions of melt fed onto the main and additional chill surfaces can be changed by controlling the position of melt feed transversely with respect to the direction of displacement of the main and additional chill surfaces. An unceasing transverse displacement of the melt feed relative to the direction of displacement of the chill surfaces has effect on the width of the main and additional metal filaments which are being formed, unceasingly increasing this width so as to equal it to the width of the aggregate pool of melt or decreasing the width until this equals the thickness of the filament and grows even smaller up to nil. A tapering off ribbon can be so formed the rate of narrowing whereof depends on the velocity of the chill surfaces and the rate of transverse displacement of the melt feed relative to the direction of displacement of the chill surfaces.

An intermittent displacement of melt feed provides for producing metal filament in the form of ribbon of different standard widths which are decided by the position of melt flow relative to the main and additional chill surfaces in the transverse direction.

The intermittent mode of displacing melt feed is the key to producing filaments of constant standard width which may range from one equalling—or being less than—the width of the aggregate pool of melt, provided the melt is being fed onto a single chill surface which can be either the main or additional surface, to one equalling the filament thickness. A filament with a square cross sectional area is obtained in this latter case.

All in all, the disclosed method provides for producing metal filaments of a constant thickness and an unceasingly decreasing width, filaments of standard different widths and filaments with square cross-sectional area without changing the factors influencing the feeding of the molten metal onto the chill surfaces.

The object of the invention is also materialized by disclosing an apparatus for producing metal filament incorporating a means of forming a metal filament from the molten metal which has a main closed chill surface and is coupled to a drive imparting motion to the chill surface, a feeder for feeding the molten metal onto the main closed chill surface and a means of coiling the metal filament formed on the main closed chill surface wherein according to the invention the means of forming metal filament has at least one additional closed chill surface which is coupled both to an individual drive imparting motion thereto and to the means of coiling the metal filament and is located next to—and in contact with—the main closed chill surface, whereby the feeder is disposed above a zone where the main and additional chill surfaces contact each other.

It is preferred to fit the feeder with provision for displacing along and across the zone of contact.

It is also preferred that the additional closed chill surface, if only one such surface is being used, is a side surface of an additional cylinder, whereby the main closed chill surface is also a side surface of a main cylinder.

It is further preferred that the main and additional cylinders are aligned with each other and have both the same diameter.

It is still preferred that the main and additional cylinders are located eccentrically with respect to each other and have different diameters.

It is desirable that the additional closed chill surface, if only one such surface is being used, is a side surface of an additional endless belt supported by at least two pulleys and the main closed chill surface is a side surface of a main endless belt supported by at least two pulleys, whereby at least one of the pulleys supporting the additional endless belt is located in alignment with a pulley supporting the main endless belt.

It is also desirable that the additional closed chill surface, if only one such surface is being used, is an inward side surface of an additional wheel, whereby the main closed chill surface is also an inward side surface of a main wheel located in alignment with the additional wheel.

It is further desirable that the main and additional wheels are provided with inward side surfaces which are inclined towards the axis of rotation of the wheels.

It is still desirable that the additional closed chill surface, if only one such surface is being used, is an end face of an additional wheel and the main closed chill surface is an end face of a main cylinder, whereby the additional wheel and the main cylinder are located in a coaxial position.

It is advisable that each additional closed chill surface, if two such surfaces are being used, is a side surface of a corresponding additional cylinder and the closed chill surface which is interposed between the additional closed chill surfaces is also a side surface of a main cylinder, whereby the main and additional cylinders are located in alignment with each other and are both of the same diameter.

By virtue of at least one additional closed chill surface incorporated into the apparatus which is located contiguously to the main closed chill surface, the melt is fed onto both the main and additional chill surfaces in a continuous stream impinging thereupon and forming an aggregate pool thereon. This pool consists of at least two parts referred to as a main pool and an additional pool of melt which are confined to the main closed chill surfaces and the additional closed chill surface, respectively. The total width of the aggregate pool of melt is the sum of the widths of the main and additional pools.

The individual drive of the additional closed chill surface imparts thereto motion at a given velocity in a given direction which are not influenced by the velocity and direction of travel of the main closed chill surface. The additional surface is thus in the state of relative motion regarding the main surface. Should the opposite be the case, i.e. in the absence of the relative motion, a continuous single metal filament would form from the single pool of melt. This would mean failure to materialize the object of the invention. The displacement of the additional surface relative to the main one causes a displacement of lower layers of the pools of melt in contact with the corresponding chill surfaces formed wherefrom are the additional and main metal filaments.

The contact set up between the additional closed chill surface and the main closed chill surface prevents concurrently oriented leaks of the melt between the chill surfaces, eliminating thus wear on the edges thereof and preventing locking of the drive imparting motion thereto which is detrimental to the integrity of the edges of the metal filaments.

The coupling of the additional closed chill surface to the means of coiling the additional metal filament is a feature of the design which enables the additional filament to be coiled with the aid of any known means independently of the coiling of the main filament. No sorting out of the main filament from the additional one is needed in this case.

The feeder disposed above the zone of contact between the main and additional closed chill surfaces feeds the melt on both the main closed chill surface and the additional closed chill surface so that the corresponding pools of melt are formed on these surfaces withdrawn wherefrom in the course of the relative displacement of the surfaces there are the main and additional metal filaments. If the feeder is disposed above either the main or additional closed chill surface, only one filament will be formed from the pool set up on this surface.

The feeder displacing along and across the zone of contact between the closed chill surfaces can feed various fractions of the melt onto the main and additional closed chill surfaces with an aim to form the main and additional filaments of various width. An unceasing displacement of the feeder across the zone of contact results in depositing the melt on both the main and additional closed chill surfaces in varying amounts. The width of, e.g., the main pool of melt will then unceasingly change due to the varying width of the additional pool of melt so that tapering off main and additional filaments will be formed from the pools, whereby the overall width of the filaments at any cross section will equal the width of the aggregate pool of molten metal.

When the feeder traverses the zone of contact between the closed chill surfaces intermittently, the filament, e.g., the main one will then be formed with a given variable width which is decided only by the width of the main pool of melt. To set a given width of the main pool, the feeder must be displaced in a precise way transversely relative to the direction of displacement of the closed chill surfaces. Apparently, this creates the prospect of producing filaments with a width which equals, or is less than, the width of the aggregate pool of melt, including filaments of a width equalling their thickness, i.e. filaments with square cross-sectional areas.

Therefore, to produce filaments of different widths there is no need in nozzels with orifices of different size. It will also be noted that an orifice with only a reduced cross-sectional area produces filament of a reduced width and a rectangular, nor square, cross section because of the melt impinging upon the closed chill surface spreads thereover in the form of a pool.

Apart from that, the nozzle orifice is eroded by the melt passing therethrough so that its dimensions increase. The melt flow rate per unit time through an eroded orifice is greater than through a noneroded one. The width of the filament prohibitively increases then beyond the specified value, and the service life of the nozzle is shortened. The disclosed apparatus copes with the problem by redistributing the fractions of melt fed onto the main and additional closed chill surface. To that end, the feeder is displaced transversely through the zone of contact between the surfaces by an amount corresponding to the extension of the width of the main filament due to the erosion of the nozzle orifice by the melt. Thus, a constant-width main filament is produced, and the additional filament is either reprocessed for use in power metallurgy or remelted.

The feeder displacing along the zone of contact between the closed chill surfaces can change the angle fed whereat is the melt, i.e. the angle a normal to the surfaces forms with the direction of feeding the melt when the chill surfaces displace in a circular path. It is known that the angle of feeding the melt influences the length of the pool of melt formed on the surface and, consequently, has effect on the thickness of the filament which is being formed. By changing the angle of feeding, which means a displacement of the feeder along the zone of contact between the closed chill surfaces, the thickness of the metal filament which is being formed can be controlled.

Such displacements of the feeder along and across the zone of contact between the closed chill surfaces pose no problems and can be readily carried out by any known means adapted for precise positioning.

By employing only one additional closed chill surface in the form of the side surface of the additional cylinder, whereby the main chill surface is also the side surface of the main cylinder, it is possible to form, separate and coil the additional metal filament in the same way as the main one which is being formed on the main chill surface of the main cylinder. The relevant sequence of events is as follows: setting up the additional pool of melt and forming from the lower layer thereof, in contact with the additional closed chill surface, the additional metal filament which sustains the effect of centrifugal forces tending to throw the filament off the chill surface in the course of forming; separating the formed additional metal filament from the closed chill surface due to the effect of centrifugal forces; coiling the additional filament by any known means, e.g., a reel with a clamp, which is also employed in coiling the main filament; employing a known means of improving the contact between the additional filament which is being formed and the closed chill surface, e.g., an oriented flow of cooling gas pressing the filament against the chill surface and preventing an early separation of the filament from the chill surface; cooling the additional cylinder by a liquid coolant, e.g. water, circulated through internal spaces—a step which is of particular importance when the apparatus operates in vacuum.

The main and additional cylinders of the same diameter are placed in alignment for the sake of simplifying their installation and imparting independent rotary motions thereto at a given velocity in a given direction. The main and additional cylinders can be supported in rolling-contact or plain bearings on a common static axle or they can be fitted to individual cantilever axles aligned with each other. Separate axles simplify the admission of coolant into the cylinders to prevent their overheating when the process of filament forming is too long.

Owing to the fact that the main and additional cylinders are located in alignment with each other and have both the same diameter, the generatrix of the, e.g., main closed chill surface of the main cylinder is also the generatrix of the additional closed chill surface of the additional cylinder. Therefore, the feeder disposed above the zone of contact between the main and additional chill surfaces provides for the feeder nozzle to be spaced equidistantly apart from both the main and additional chill surfaces. In producing wide metal filament referred to as ribbons, use is made of a nozzle with a slot-type orifice and a minimum clearance is set between the nozzle and the chill surface due to known reasons. Since the main and additional cylinders are of the same diameter, there is no problem in maintaining a constant clearance between the nozzle with the slot-type orifice and the main and additional closed chill surfaces while the feeder is either static or heads towards the zone of contact, being displaced transversely relative to the direction of motion of the surfaces. Moreover, the equality of the diameters of the main and additional filaments provides for producing rectangular metal filament of given different standard widths, including one with a width equalling the filament thickness and also tapering off filament with an unceasingly changing, e.g. decreasing, width.

The width of the e.g., main metal filament varies with, and is decided by, the transverse position of the feeder relative to the zone of contact between the closed chill surfaces, and the unceasing changing of the width of the main filament with its length is dependent upon the velocity of the filament and that of the feeder when this is displacing transversely relative to the direction of motion of the chill surfaces. When coiled, the tapering off filament forms a coil which is a conical body of revolution the turns whereof are parallel to the longitudinal axis of revolution of the coil.

Equal diameters of the main and additional cylinders located in alignment with each other is a feature of the design which provides for producing the main and additional metal filaments of the same width and thickness. The cylinders revolve at the same velocity in opposite directions, and the feeder is disposed above the closed chill surfaces so as to cast thereon pools of melt of the same width formed wherefrom are the main and additional ribbons of the same width. The melt is fed in this case along a normal to the main and additional chill surfaces with the result that the main and additional pools are exactly of the same size and similar main and additional metal filaments originate therefrom.

The alignment cylinders of the same diameter can be served by a feeder in the form of either a crucible with a nozzle pressure-fed wherethrough in a continuous stream with a cross-sectional area equalling or approaching in size the cross-sectional area of the feeder nozzle orifice is the melt or a bath containing the melt in a free-flowing state which is located below the cylinders so that the chill surfaces thereof are in contact with the surface of the melt in the bath.

The aligned cylinders of the same diameter can revolve in the same direction or in opposite directions. If the cylinders revolve in the same direction, the velocity of one thereof, e.g. that of the additional cylinder must be higher than the velocity of the main cylinder by an amount which enables the additional metal filament to separate from the main filament in the course of forming. As the revolving additional closed chill surface of the additional cylinder takes the lead over the main closed chill surface of the main cylinder, the additional filament which is being formed on the additional cylinder will stay in contact with the additional closed chill surface during a shorter period than the main filament which contacts the main closed chill surface. The additional filament separates from its chill surface ahead of the main filament due to the action of centrifugal forces which increase with the velocity of the additional closed chill surface. The early separation of the additional filament does not permit its material to become amorphous and, unlike the main filament which is amorphous, the additional filament fails to meet the requirements specified for the finished product.

To produce amorphous additional metal filament, the main and additional cylinders are located eccentrically relative to each other. They must have different diameters and revolve in the same direction at different linear velocities.

If the linear velocity of the additional closed chill surface is known and so is the velocity whereat the additional metal filament becomes separated from the main one in the course of forming, there is no difficulty to calculate the diameter of the additional cylinder which gives rise to separating centrifugal forces coming on the additional metal filament which equal—or are even smaller than—the separating centrifugal forces acting on the main filament. When the additional closed chill surface travels ahead of the main closed chill surface, the diameter of the additional cylinder must be greater than that of the main one. This diminishes the effect of the centrifugal forces exposed whereto in the course of forming is the additional metal filament and prolongs the period of contact between the additional filament and its chill surfaces so that the material of this filament is amorphous, as specified.

The eccentrically located main and additional cylinders provide for positioning the additional closed chill surface next to, and in contact with, the main closed chill surface so that a single pool of melt can be cast on the main and additional chill surfaces at a time. The eccentric cylinders provide for contacting the main closed chill surface by the additional one in such a way that the generatrix of the additional closed chill surface coincides in the zone of contact with the generatrix of the main closed chill surface so that a single pool of melt is cast on both surfaces formed wherefrom are the main and additional metal filaments the material whereof is amorphous, as specified. This simplifies the coiling of metal filament in producing rope yearn when a hopper located in the path of travel of the main and additional filaments can be used to that end.

The feeder displacing along and across the movable main and additional chill surfaces provides for producing rectilinear filaments of given variable widths, including one equalling the filament thickness, and also tapering off filaments, i.e. those with an unceasingly changing, e.g. decreasing, width.

The additional closed chill surface in the form of the side surface of the additional endless belt supported by at least two pulleys, whereby the main closed chill surface is the side surface of the main endless belt supported by at least two pulleys, provides for producing the main and additional metal filaments under the conditions devoid of the centrifugal forces which separate the filaments that are being formed from the corresponding closed chilled surfaces. These conditions are created by feeding the melt onto the chill surfaces travelling along a rectilinear path, i.e. within the lengths of the endless belts between two adjacent supporting pulleys which travel rectilinearly. In the absence of centrifugal forces, the contact of the filaments which are being formed with the chill surfaces lasts longer than this is the case when the melt is cast on the outside surface of the cylinders so that the filaments can be cooled to much lower temperatures, e.g. to those which equal the temperature of the chill surfaces of the endless belts. These conditions are conductive to producing metal filaments of given fine-grain crystalline structures or amorphous ones. The endless belts can be supported each by more than two pulleys. Their number is decided by a given belt tension which eliminates vibration and by a need to install spray atomizers next to the inward side surface of the belts for cooling these down.

The requirement to install at least one of the pulleys supporting the additional belt in alignment with a pulley supporting the main endless belt stems from the need to dispose the additional closed chill surface next to, and in contact with, the main closed chill surface. The aligned pulleys enable the endless belts to contact each other in the zone of passing around the pulleys so that the generatrix of the side surface of the additional belt coindies with the generatix of the side surface of the main belt within the zone of contact. As a result, a single pool of molten metal is cast on the surfaces of the belts in the zone of contact formed wherefrom due to the relative displacement of the travelling endless belts there are the additional and main metal filaments. More promising is the plan when two pulleys giving support to the additional belt are located in alignment with two pulleys supporting the main endless belt. In this case, the additional belt contacts the main one over its length between the pulleys and, as a result, the feeder can be installed at any point above the belts within the zone of contact. Suitable drives set the belt into motion relative to each other in the same or opposite direction. By displacing the feeder transversely with respect to the direction of travel of the endless belts, rectilinear filaments of given variable widths, including one equalling the filament thickness can be produced and also tapering off filaments, i.e. those with an unceasingly changing, e.g. decreasing, width.

The additional closed chill surface in the form of the inward side surface of the additional wheel, whereby the main closed chill surface is also the inward side surface of the main wheel located in alignment with the additional wheel, serves to improve—by virtue of the centrifugal forces coming into play—the contact between the metal filaments which are being formed and the chill surface so as to speed up the chilling rate. The centrifugal acceleration of the liquid metal cast on the inward side surface of the wheels in order to form metal filaments stimulates the spreading of the melt and ensures a good heat transfer to the chill surface with the result that the material of the filament is of a given fine-grain crystalline structure or amorphous.

The main and additional wheels, if placed in alignment with each other, can be of the same inside diameter. Consequently, a single pool of molten metal is cast on the main and additional inward side surface formed wherefrom are the main and additional filaments while the wheels revolve relative to each other in a given direction and at a given velocity. When the wheels revolve in opposite directions at the same velocity while the feeder is positioned symmetrically with respect to the zone of contact in the transverse direction, the main and additional filaments are of the same geometry, width and thickness. The main and additional filaments formed on the inward side surface of the wheels can be coiled by any known means, e.g. by a system of rollers or scrapers. However, filaments can curve in this case, impairing product quality. To avoid this, it is good practice to incline the inward side surfaces of the wheels towards the axis of their rotation or, in other words, to make these surfaces conical. The wheels contact each other at the circumferences of the smaller inside diameters, which are both the same, so that a single pool of melt is cast on both surfaces formed wherefrom are the main and additional filaments which can be so coiled without hindrance. The filaments can be separated from the chill surfaces by centrifugal forces, provided the inclined surfaces make an adequate angle with the axis of rotation of the wheels, or scrapers can be employed to that end. In this case the filaments moving with the wheels are removed therefrom in opposite directions relative to the zone of contact between the chill surfaces without bending. The inward side surfaces of the wheels can make each an angle with the axis of rotation which causes the contacting main and additional side surfaces of the wheels to form a single conical surface. In other words, the generatrix of, e.g., the main chill surface of the main wheel becomes then an extension of the generatrix of the additional chill surface of the additional wheel. The wheels contact each other in such a way that the circumference with a larger inside diameter of the additional wheel is contiguous to the circumference with a smaller inside diameter of the main wheel. Since the two diameters equal each other, a single pool of melt can be cast on the chill surfaces to form therefrom the filaments. The filaments travelling with the corresponding chill surfaces are then withdrawn therefrom in the same directions relative to the zone of contact by any known means or due to centrifugal forces if the generatrix of the two chill surfaces makes an adequate angle with the axis of rotation of the wheels.

The transverse displacement of the feeder relative to the zone of contact between the chill surfaces affords control of the width of the filaments formed, up to a width equalling the filament thickness. The production of wide filaments is a problem due to the difficulties encountered in withdrawing them from the inward surfaces.

The apparatus wherein the additional closed chill surface is the end face of the additional wheel and the main closed chill surface is the end face of the main cylinder, whereby the additional wheel and the main cylinder are located in a coaxial position, can produce naturally curves main and additional filaments rather than rectilinear ones which are cast on the outside surfaces of the cylinders. When the melt is cast on the end face of the cylinder, the filament which is being formed stays in contact with the chill surface for a time—acquiring a curvature corresponding to the radius of the cylinder—before being separated from the end face chill surface by the effect of centrifugal forces and coiled into a spiral the diameter whereof depends on such process variables as the velocity of the chill surface in the zone of casting the melt and the diameter of the end face of the cylinder in the zone of casting the melt. Since the main cylinder and additional wheel are located in the coaxial position, the main chill surface at the end face of the cylinder and the additional chill surface at the end face of the wheel displace in the same plane so that the melt can be cast on both the main and additional chill surfaces. The single pool of melt produced thereon is the source formed wherefrom in the course of the relative displacement of the main and additional chill surfaces at a given velocity and in a given direction there are the main and additional filaments.

The feeder displacing either transversely relative to the direction of travel of the chill surfaces or towards the axis of rotation of the cylinder and wheel provides for producing curved metal filaments replicating the curvature of the chill surface they are formed on. Filaments of given variable widths, including one which equals the filament thickness, or those of the tapering off type with an unceasingly changing, e.g. decreasing, width can be produced in this way. When being coiled, a tapering off filament forms a conical body of revolution the turns whereof are located at right angles to the axis of rotation of the coil.

The apparatus with two additional closed chill surfaces formed by the side surfaces of the corresponding additional cylinders and a single main closed chill surface which is interposed between the additional chill surfaces and is also the side surface of the main cylinder, whereby the main and additional cylinders are aligned with each other and are of the same diameter, is designed to produce rectilinear metal filaments of a constant width and given variable thicknesses. The aligned main cylinder and two additional cylinders—all three being of the same diameter— form the aggregate pool comprising the central main pool and two outermost additional pools of melt, because of the generatrix of the side surface of the main cylinder being also the generatrix of the side surfaces of the additional cylinders. The feeder is located in this case above the zone of contact between the additional cylinders and the main cylinder, i.e. above the three cylinders, and the width of the nozzle orifice exceeds that of the main cylinder. The melt ejected in a continuous stream through the slot-type orifice of the nozzle spreads, on contacting the side surfaces of the cylinders, over the entire width of the main cylinder so as to form there a single pool. When the main and additional cylinders are all set to revolve at a given velocity and in given directions, they extract from the pool the main filament in the form of a ribbon with a width equalling that of the main cylinder and two additional filaments, the latter being formed on the additional cylinders. If the main closed chill surface displaces at a constant velocity and the conditions of feeding the melt remain unchanged, the main filament has a constant thickness and a width equalling that of the main cylinder. By increasing or decreasing the velocity of the main closed chill surface, the thickness of the main metal filament decreases or increases, respectively, while its width remains equal to that of the main cylinder. Any variations in the conditions of the aggregate pool of melt resulting from a non-uniform rate of melt feed through the feeder nozzle, a changing temperature of the melt and other variable factors have no effect on the width of the main metal filament. Varying are only the widths of the additional filaments formed on the additional cylinder which can be used in powder metallurgy or remelted. The apparatus with two additional cylinders and one centrally located main cylinder needs on feeder nozzle with the orifice of a precise width. The only requirement the slot-type orifice of the feeder must meet is that its width should be greater than that of the main chill surface of the main cylinder. The width of the main metal filament is also not influenced by the erosion of the nozzle orifice by the melt ejected there through and the resulting widening of the aggregate pool of melt. What is influenced in this case is the width of the additional filaments only. To switch over to the production of metal filament of another standard width, it is necessary to replace the main cylinder by one with the appropriate width of the main closed chill surface without changing the feeder, provided the width of its nozzle orifice is greater than that of the main closed chill surface. Consequently, a single uniform feeder with a constant nozzle orifice can be employed to form filaments of various given widths.

Thus, the disclosed method of producing metal filament and the apparatus materializing this method fully realize the object of the invention. The dynamic effect sustained by the melt and the disclosed features of the design of the apparatus provide for:

forming main metal filament of a width which is much smaller of the width of the stream of melt cast on the chill surface so that the product can be filament of a width equalling the filament thickness;

executing positive control of the width of main metal filament in the course of forming;

obtaining a main metal filament of a guaranteed constant width all over the entire length;

retaining the material of the main metal filament in the amorphous or fine-grain crystalline state, as specified;

forming at least one additional metal filament with properties which are not inferior to those of the main metal filament.

SUMMARY OF THE DRAWINGS

Preferred embodiments of the invention will now be described by way of examples with reference to the accompanying drawings, wherein.

PREFERRED EMBODIMENT OF THE INVENTION

Figure 1:
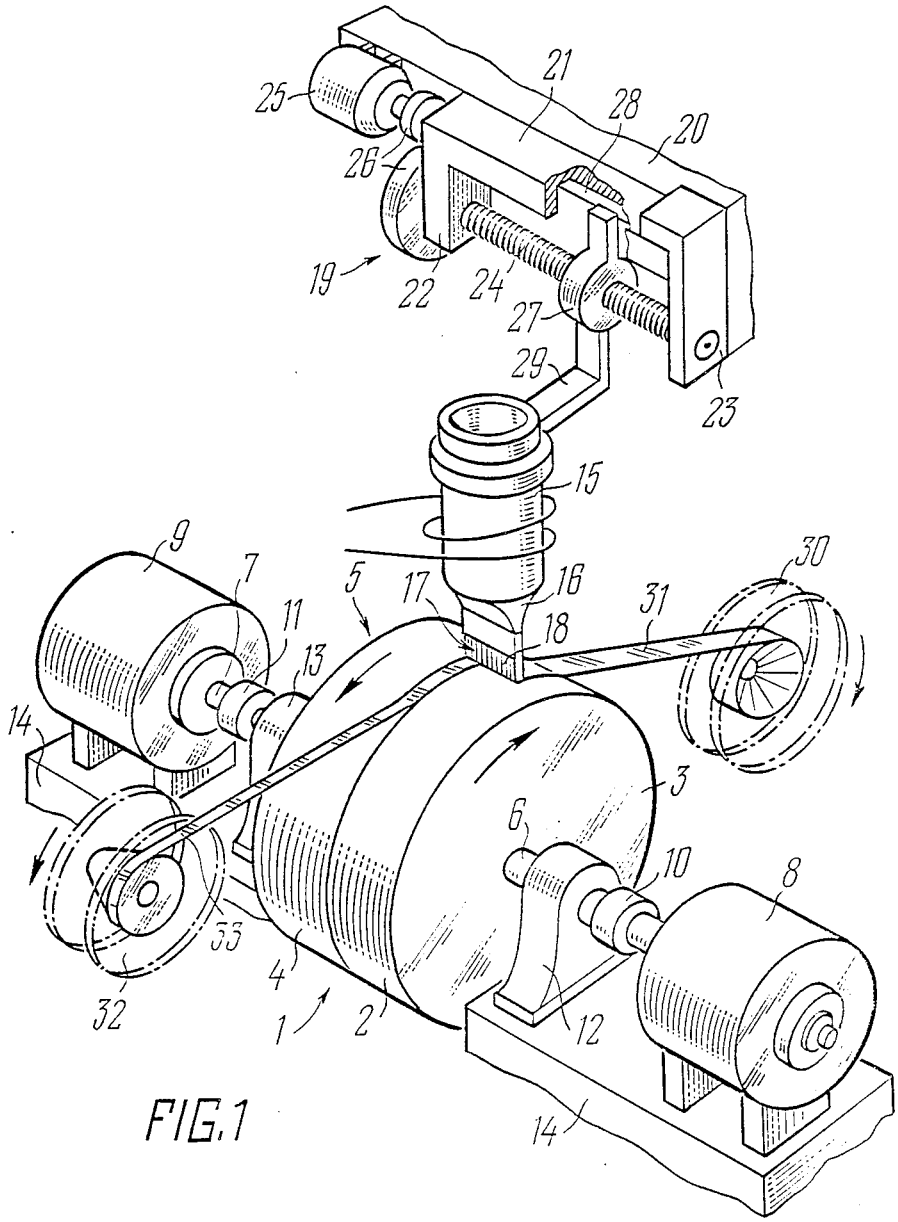
FIG. 1 is a schematic perspective view of the apparatus for producing metal filament according to the invention.

Referring to FIG. 1, the apparatus for forming metal filament from molten metal incorporates a means 1 of forming the filament which consists of a main closed chill surface 2 in the form of an outward side surface of a main cylinder 3 and an additional closed chill surface 4 in the form of an outward side surface of an additional cylinder 5. The cylinders 3 and 5 are of the same diameter and are located in alignment with each other, whereby their adjacent surfaces 2, 4 contact each other so that the generatrix of the surface 2 of the main cylinder 3 coincides with the generatrix of the surface 4 of the additional cylinder 5. The cylinders 3, 5 are fitted to their respective shafts 6, 7 and are coupled to corresponding means 8, 9 of imparting rotary motion by couplings 10, 11. The shafts 6, 7 revolve being supported in bearings 12, 13 fitted to a bedplate 14. The means 8, 9 of imparting motion to the cylinders 3, 5 in opposite directions or in the same direction (FIG. 2) at different velocities are d.c. motors.

Superimposing the chill surfaces 2, 4 (FIG. 1) with provision for displacement is a feeder 15 a nozzle 16 whereof has an orifice 17 squirted wherethrough on the chill surfaces 2, 4 is a molten metal 18.

The feeder 15 can be displaced along the axis of rotation of the cylinders 3, 5 by a driving means 19 fitted to a plate 20. The driving means 19 consists of a main member 21 fitted whereto at the ends there are two side members 22, 23 referred to as an unseparable and a separable one, respectively. A lead screw 24 revolving by a motor 25 through a gear 26 is supported in rolling-contact bearings fitting into the side members 22, 23. A nut 27 is fitted to the lead screw 24 with provision for displacing back and forth without revolving, a groove 28 being provided in the main member 21 to that end. A bracket 29 giving support to the feeder 15 is attached to the nut 27. A similar outfit is used to displace the feeder 15 at right angles to the axis of rotation of the cylinders 3, 5 and to turn the feeder about its axis.

A means 30 of coiling a main metal filament 31 is located at that side of the apparatus where this filament is separated from the main cylinder 3, and a means 32 of coiling an additional metal filament 33 is located at the side of the apparatus where this filament is separated from the cylinder 5. The means 30 and 32 are provided in the form of reels with clamps and are installed so that their axes of rotation are parallel to the axes of the shafts 6, 7.

Figure 3:
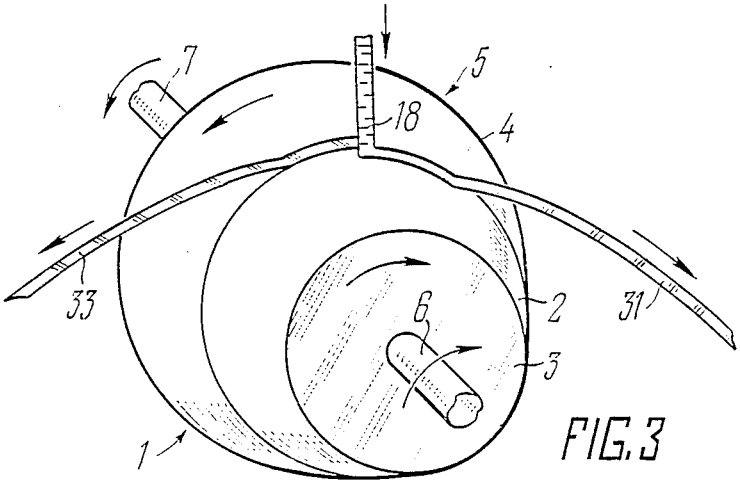
FIG. 3 is a schematic perspective view of the means of forming metal filament of the apparatus shown in FIG. 1 which consists of a main and additional cylinders the side surfaces whereof are inclined with respect to the axis of rotation of the cylinders.

In another embodiment of the invention, the means 1 of forming metal filament (FIG. 3) consists of a main closed chill surface 2 in the form of an outward inclined side surface of the main cylinder 3 and an additional closed chill surface 4 in the form of an outward inclined side surface of the additional cylinder 5. The means 1 of this kind provides for forming naturally curved main and additional filaments 31, 33.

Figure 2:
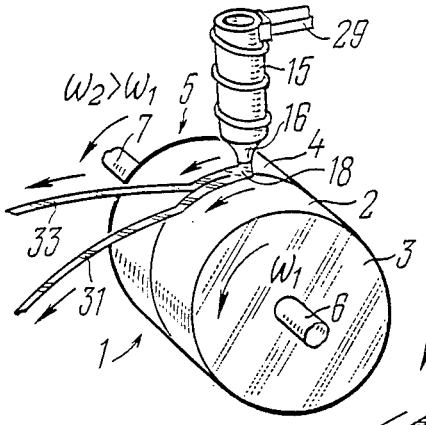
FIG. 2 is a schematic perspective view of the means of forming metal filament of the apparatus shown in FIG. 1 which consists of a main and additional cylinders revolving in the same direction at different velocities.

In a further embodiment of the invention, the means 1 incorporates the main cylinder 3 and an additional cylinder 34 (FIG. 4) which replaces the additional cylinder 5 of FIG. 2, whereby the outside diameter of the additional cylinder 34 is greater than that of the main cylinder 3 and both cylinders 3 and 34 are located eccentrically relative to each other. The period during which the additional metal filament 33 stays in contact with the chill surface 4 is thus extended, without changing the velocity of the chill surfaces 2, 4 (FIG. 2), so as to be close to the period of contact between the main metal filament 31 (FIG. 4) and the chill surface 2. This guarantees that both metal filaments 31 and 33 are amorphous. For a more deeper understanding of the process it must be pointed out that the main and additional metal filaments 31, 33 can be extracted from the melt 18 by the cylinders 3, 5 (FIG. 2) of the same diameter and revolving in the same direction only if there is a difference between the linear velocities of the surfaces 2, 4. When the velocity of the surface 4 of the additional cylinder 5 exceeds by a certain amount that of the surface 2 of the main cylinder 3, the centrifugal forces separating the additional metal filament 33 from its chill surface exceed the centrifugal forces separating the main metal filament 31 from its chill surface. The period of contact of the additional metal filament 33 with the chill surface 4 will be shorter than that of contact of the main metal filament 31 with the chill surface 2 with the result that some known materials fail to attain amorphous state. To reduce the effect of the separating centrifugal forces on the additional metal filament 33, the diameter of the additional cylinder 34 (FIG. 4) is increased. Since the linear velocity of the chill surface 4 is higher than that of the surface 2, the period of contact of the filament 33 with the surface 4 of the additional cylinder 34 is definitely extended.

Figure 5:
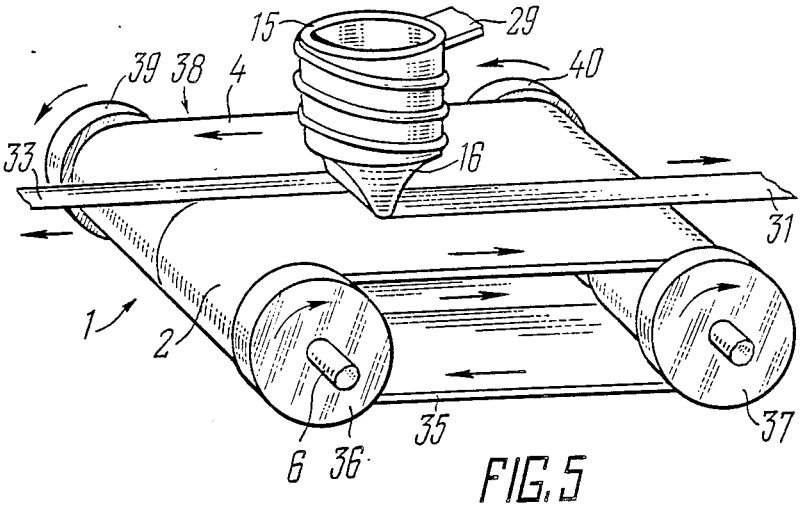
FIG. 5 is a schematic perspective view of the means of forming metal filament of the apparatus shown in FIG. 1 which consists of a main and additional endless belts.

To eliminate the effect of the separating centrifugal forces on the main and additional metal filaments 31, 33 during the period of their forming, it is practical to provide the means 1 of forming metal filament in the form of a main endless belt 35 (FIG. 5) having a main chill surface 2 and supported by pulleys 36, 37 and an additional endless belt 38 supported by pulleys 39, 40. It is also practical to locate the pulleys 36, 37 in alignment with the pulleys 39, 40 so that the additional endless belt 38 is contiguous to the main endless belt 35 all the way along its length contained between the pulleys 36, 37 and the generatrix of the side surface of the main endless belt 35 coincides with the generatrix of the side surface of the additional endless belt 38 within the lengths contained between the pulley 36, 39 and 37, 40. When the melt is cast on the runs of the belts 35, 38 travelling rectilinearly between the pulleys 36, 37, the extracted filaments 31, 32 sustain no separating centrifugal forces and the period of their contact with the corresponding surfaces 2, 4 is extended with the result that the material of the finished filaments 31, 33 is either amorphous or fine-grain crystalline, as specified.

Figure 6:
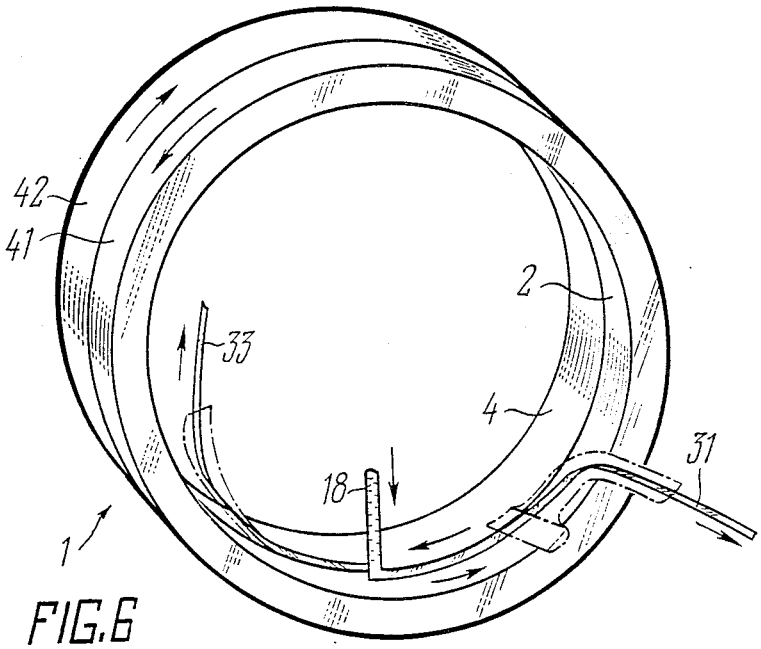
FIG. 6 is a schematic perspective view of the means of forming metal filament of the apparatus shown in FIG. 1 which consists of a main and additional wheels located in alignment with each other and having cylindrical inward surfaces.
Figure 7:
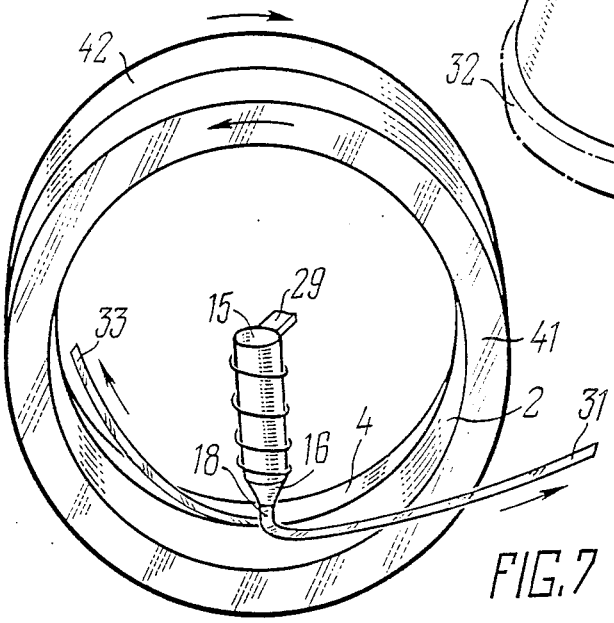
FIG. 7 is a schematic perspective view of the means of forming metal filament of the apparatus shown in FIG. 1 which consists of a main and additional wheels with inclined inward surfaces.

To increase the rate of heat transfer from the filaments 31, 33 (FIG. 6) in the course of their forming, it is desirable to use a means of forming filaments in the form of a main wheel 41 with a main inward chill surface 2 and an additional wheel 42 with an additional inward chill surface 4 which are in alignment with each other. The inward surfaces 2, 4 of the wheels 41, 42 can be of cylindrical configuration. But problems are likely to be then encountered due to known reasons in producing wide filaments which are associated with the separation of the filaments from the chill surfaces 2, 4 and coiling. Therefore, it is advisable to incline the inward surfaces 2, 4 of the wheels 41, 42 (FIG. 7) towards the axis of their rotation and facilitate in this way the separation and coiling of the filaments in any known way. As the melt 18 is cast on the chill surfaces, the filaments 31, 33 rapidly cool down and their material turns amorphous.

Figure 8:
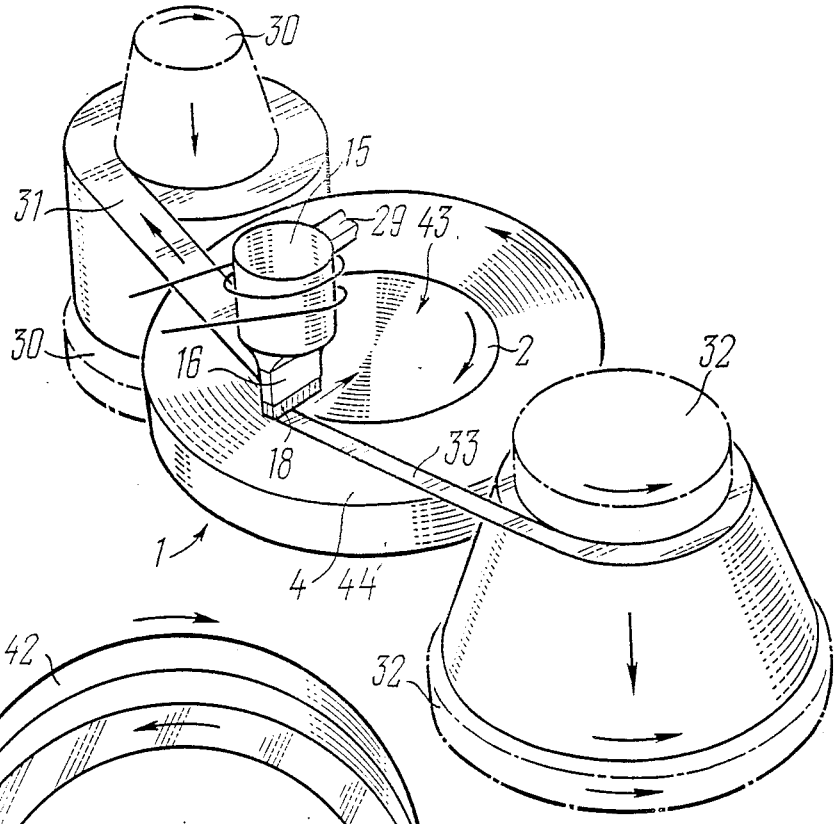
FIG. 8 is a schematic perspective view of the means of forming metal filament of the apparatus shown in FIG. 1 which consists of a main cylinder and additional wheel located in a coaxial position.

To produce self-curving filaments 31, 33, the means 1 of forming them consists of a main cylinder 43 (FIG. 8) the main chill surface 2 whereof is an end face 43 and an additional wheel 44 which is located in a coaxial position relative to the cylinder 43 and whose additional chill surface 4 is also an end face. The filaments 31, 33 formed from the melt 18 which is cast on the surfaces 2, 4 of the cylinder 43 and the wheel 44, respectively, curve on their own accord with radii corresponding to the radii where the melt is being cast on the corresponding chill surfaces 2, 4. Also the larger radius of the main filament 31 corresponds to the smaller radius of the additional filament 33. An unceasing displacement of the feeder 15 relative to the axis of rotation of the cylinder 43 and the wheel 44 provides for producing self-curving filaments 31, 33 of continuously variable widths. When coiled, these filaments form conical bodies of revolution the turns whereof fall into planes making right angles with the axis of rotation of the coil.

To produce a constant-width filament 31 (FIG. 1) with a variable thickness, the means 1 of forming filament provided with the main and additional cylinders 3, 5, respectively, is supplemented with an additional cylinder 45 (FIG. 9) a side surface whereof is used as an additional chill surface 46. The cylinder 45 is of the same diameter as the cylinders 3, 5 (FIG. 1) and is located in alignment therewith. All three cylinders revolve about the same axle, being supported thereon in plain or rolling-contact bearings. The cylinder 45 can be easily set into rotary motion by the drive of the cylinder 5. An alteration of the velocity of the main chill surface 2 of the cylinder 3 (FIG. 9) affects only the thickness of the filament 31 while its width remains unchanged, being decided by the width of the surface 2 of the cylinder 3. The additional filaments 33, 47 separated from the cylinders 5, 45 revolving in opposite direction compared with the cylinder 3 are collected in a hopper for remelting. To switch over to the production of the filament 31 in another standard width, the main cylinder must be replaced by another one of the appropriate width taking into account the requirement that the width of the melt 18 cast should be greater than that of the main cylinder 3.

In operation, a batch of raw material charged into the feeder 15 (FIG. 1) is melted with the aid of an induction coil assembly and the melt temperature is brought by 100° C. above the melting point. The main cylinder 3 and the additional one 5 aligned therewith are set into rotary motion at given velocities in given direction by the rotary drives 8, 9. The feeder 15 is set above the cylinders 3, 5 in a given position, and the melt 18 is gravity-fed or squirted under a pressure onto the main and additional chill surfaces 2, 4 of the cylinders 3 and 5, respectively, through the orifice 17 of the nozzle 16. Impinging upon the surfaces 2, 4, the melt 18 spreads over these surfaces of the cylinders 3, 5 in the form of a single pool extracted wherefrom—due to the displacement of the surfaces 2, 4 relative to each other—there are the main and additional filaments 31, 33 which are separated from the revolving cylinders by centrifugal forces before being coiled. An intermittent displacement of the feeder 15 in the transverse direction relative to the direction of motion of the surfaces 2, 4 results in an intermittently changing width of the pool of the melt 18 so that filaments of different width can be formed on the main surface 2 and the additional surface 4. A symmetrical feed of the melt 18 onto the chill surfaces 2, 4 revolving in opposite directions at the same velocity provides for forming the filaments 31, 33 of the same width and thickness. The feeder 15 can be set so as to form the pool of a width extracted wherefrom by the chill surface 2 of the main cylinder 3 is the main filament 31 of a width equalling the filament thickness, i.e. a filament with a square cross-sectional area. An unceasing displacement of the feeder 15 in the transverse direction provides for forming tapering off main and additional filaments 31, 33, i.e. filaments of a width unceasingly changing with the length.

When the cylinders 3 and 5 (FIG. 2) revolve in the same direction, the apparatus operates in the same way as indicated above except that the coiling means of both filaments are located at the same side of the means 1 of forming metal filament. Filaments 31, 33 of the same thickness cannot be produced in this case, for the surfaces 2, 4 revolve at different velocities.

Figure 4:
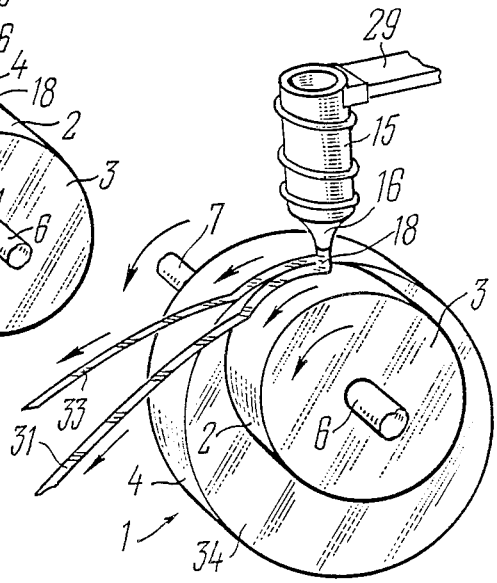
FIG. 4 is a schematic perspective view of the means of forming metal filament of the apparatus shown in FIG. 1 which consists of a main and additional cylinders of different diameters located eccentrically with respect to each other.

No changes in the performance of the apparatus occur when the means 1 of forming filament are provided in the form of the eccentric main and additional cylinders 3, 34 (FIG. 4). An extended period of contact of the additional filament 31 with the chill surface 4 of the cylinder 34 provides for producing amorphous main and additional filaments 31, 33.

The performance of the apparatus remains the same when the means 1 of forming metal filament consists of the main endless belt 35 (FIG. 5) supported by the pulleys 36, 37 and the additional endless belt 38 with the supporting pulleys 39, 40 which is contiguous to the main belt between the pulleys 36, 37. The feeder 15 is located above the belts 35, 38 and within their lengths which travel rectilinearly so that no centrifugal forces tending to separate the filaments 31, 33 from their chill surfaces are set up in this case. The belts 35, 38 are set moving relative to each other by the pulleys 36, 39 coupled to the rotary drives 8, 9.

When the means 1 of forming metal filament incorporates the main wheel 41 (FIG. 6) and the additional wheel 42 which are located in alignment with each other and set into rotary motion relative to each other by the drives 8, 9, no changes in the performance of the apparatus occur except that the melt is cast on the inward side surfaces 2, 4 of the main and additional wheel 41, 42. The filaments are withdrawn from the wheels 41, 42 and coiled by any known means that may vary dipending on the shape of the inward surfaces of these wheels which may be either cylindrical or inclined.

The performance of the apparatus remains unchanged when the means 1 of forming metal filament consists of the main cylinder 43 (FIG. 8) and the additional wheel 44 located in a coaxial position. The feeder 15 surmounts the end faces 2, 4 of the cylinder 43 and the wheel 44. The filaments 31, 33 which are being formed have a curved shape replicating the shape of the surfaces 2, 4 cast whereon is the melt 18. An unceasing displacement of the feeder 15 radially towards the axis of rotation of the cylinder 43 and the wheel 44 provides continuous control of the widths of the filaments 31, 33 in the course of forming.

When the means 1 of forming metal filament consists of two additional cylinders 5 (FIG. 9) and the main cylinder 3 which are all of the same diameter and share the same axle, and connected by the drives 8, 9 being thus placed in alignment with each other, the performance of the apparatus is the same save that the orifice 17 of the nozzle 16 of the feeder 15 is wider than the main cylinder 3. This permits the main filament 31 to be produced with a width equalling that of the cylinder 3. The thickness of the filament 11 can be controlled, if necessary, by altering the velocity of the main chill surface 2. The width of the main filament is constant in this case, equalling the width of the cylinder 4. The additional filaments 33, 47 can be arranged to coil in the same hopper by revolving the additional cylinders in the opposite direction compared with the cylinder 3.

The above specification covers many possible embodiments of the invention. Nevertheless, it will be noted by those versed in the art that modifications of features of the design not departing from the spirit and scope of the invention may occur.

The examples which follow provide a good illustration of the invention in its optimal embodiments.

EXAMPLE 1

Metal filaments were produced on the apparatus according to the invention as illustrated in FIG. 1.

The main and additional water-cooled cylinders in oxygen-free copper had a diameter of 300 mm and a width of 40 mm each. The feeder cast wherethrough was molten metal consisted of a quartz crucible with a nozzle in the bottom the orifice whereof was 0.5 mm in diameter. Melt composition was $Fe_{83}B_{17}$.

The variables of the metal filament casting process were as follows: the velocity of the cylinders revolving in opposite directions, 2800 rpm; the overpressure applied to the gas (argon) for feeding the melt, 0.035 MPa; nozzle-to-chill surface clearance, 2 mm; nozzle position, symmetrical relative to the line of contact between the chill surface of the cylinders and at right angles to these surfaces; melt temperature, 1350° C.

Concurrently produced in this way were a main and an additional filament of unlimited length each with a thickness of 22 μm and a width of 0.31 mm. The X-ray diffraction analysis of the metal filaments so produced proved that they were amorphous.

EXAMPLE 2

Amorphous metal ribbons were formed from a $FeSi_{10}B_{12}$ alloy on the apparatus used in Example 1. The main and additional water-cooled cylinders in oxygen-free copper measured each 300 mm in diameter and 40 mm in width. The feeder for casting the melt was a quartz crucible with a nozzle in the bottom the rectangular orifice whereof was 0.2 mm by 10.0 mm.

The variables of the metal filament casting process were as follows: the velocity of the cylinders revolving in opposite directions, 2600 rpm; the overpressure applied to the gas (argon) for feeding the melt, 0.035 MPA, nozzle-to-chill surface clearance, 0.6 mm, the rate of displacement of the crucible nozzle along the axis of rotation of the main cylinder towards the additional cylinder from the original position above the chill surface of the main cylinder, 2 mm/s; direction of melt feed, at right angles to the chill surface; melt temperature, 1300° C.

The product was 200-m metal filament of the tapering off type with a thickness of 16 μm and a width unceasingly decreasing from 10.2 mm to 0. The X-ray diffraction analysis showed that the filaments were amorphous.

EXAMPLE 3

Figure 9:
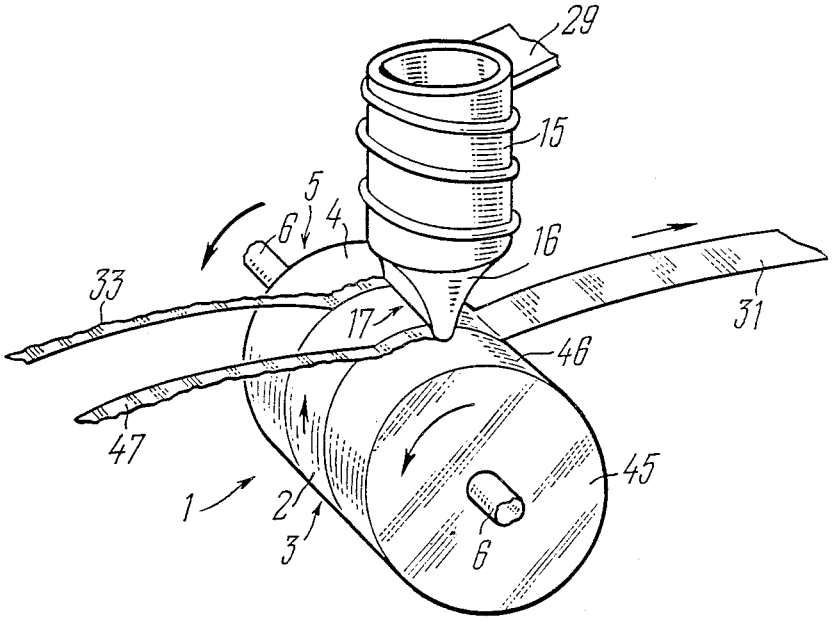
FIG. 9 is a schematic perspective view of the means of forming metal filament of the apparatus shown in FIG. 1 which consists of two additional cylinders interposed wherebetween is a main cylinder of the same diameter.

Metal filaments were produced on the apparatus according to the invention as illustrated in FIG. 9. The diameters of the main and two additional water-cooled cylinders in oxygen-free copper were 300 mm. The width of the central main cylinder was 8 mm and that of the additional cylinders was 10 mm each. The feeder for casting the melt was a quartz crucible with a bottom nozzle the orifice whereof was 0.2 mm by 10.0 mm. The melt composition was $FeSi_{10}B_{12}$.

The variables of the metal filament casting precess were as follows: the velocity of revolving cylinders, 2600 rpm; the direction of the rotary motion of the cylinders, the two additional cylinders revolved in the opposite direction compared with the main cylinder; the overpressure applied to the gas (argon) for feeding the melt; 0.035 MPa; nozzle-to-chill surface clearance 0.6 mm; nozzle position, the nozzle was set so as to feed the melt onto the chill surface of the three cylinders at right angles thereto; melt temperature, 1300° C.

The product was a main filament and two additional filaments of unlimited length and a 16 μm thickness. The width of the main filament was 8 mm and that of the additional filaments was 1.1 mm each.

The filaments were amorphous, as shown by X-ray diffraction analysis.

EXAMPLE 4

The equipment and technique of producing amorphous metal filaments from a $FeSi_{10}B_{12}$ alloy were the same as in Example 3 except the velocity of the main central cylinder which was 3000 rpm. The main metal filament so produced was 8 mm wide and 13 μm thick, and the two additional filaments were each 1.1 mm wide and 16 μm thick.

According to an X-ray diffraction analysis the filaments were amorphous.

INDUSTRIAL APPLICABILITY

The invention may be used to advantage in producing amorphous and fine-grain crystalline metal filaments in the form of wire with square cross section, constant-thickness ribbon of a width changing continuously with the length and ribbon of a given width with even edges. No slitting of the filament is required.

Unique physical and mechanical properties of metal filaments with amorphous and fine-grain crystalline structure define their fields of application which are electrical engineering, the electronic and instrument-making industries and some other industries.

We claim:

1. A method of producing metal filaments comprising the steps of arranging a main chill surface and at least one additional chill surface in substantial contact with each other with a junction line formed between the surfaces, continuously moving the main chill surface and the additional chill surface in a manner providing relative displacement between the surfaces, continuously feeding a supply of molten metal simultaneously onto the main chill surface and the additional chill surface such that the supply of molten metal extends across the junction line between the surfaces, using the main chill surface and the additional chill surface and the relative displacement therebetween to chill the molten metal on the respective surfaces and separate the molten metal into a main filament and an additional filament, separating the main filament from the main chill surface and the additional filament from the additional chill surface and independently reeling the main filament and the additional filament after separation from the respective surfaces.

2. A method as claimed in claim 1 wherein the main and the additional chill surfaces are moved in the same direction at different speeds.

3. A method as claimed in claim 1 wherein the main and the additional chill surfaces are moved in opposite directions respectively.

4. A method as claimed in claim 1 wherein a ratio between portions of said supply fed onto the main surface and onto the additional surface is varied in the course of production of the respective filaments.

5. A method as claimed in claim 1 wherein the surfaces are curved and the supply of molten metal is fed onto the surfaces in a non-tangential direction.

* * * * *